US008381499B2

(12) United States Patent
Parisini et al.

(10) Patent No.: US 8,381,499 B2
(45) Date of Patent: Feb. 26, 2013

(54) MACHINE AND METHOD FOR CANNING TUNA AND THE LIKE

(75) Inventors: Gianluca Parisini, Parma PR (IT); Ian Thomas Cooper, Gattatico RE (IT)

(73) Assignees: John Bean Technologies S.p.A., Parma (IT); Bolton Alimentari S.p.A., Cermenate (IT)

( * ) Notice: Subject to any disclaimer, the term of this patent is extended or adjusted under 35 U.S.C. 154(b) by 575 days.

(21) Appl. No.: 12/614,222

(22) Filed: Nov. 6, 2009

(65) Prior Publication Data

US 2010/0166927 A1 Jul. 1, 2010

(30) Foreign Application Priority Data

Dec. 31, 2008 (EP) ..... 08425826

(51) Int. Cl.
*B65B 25/06* (2006.01)

(52) U.S. Cl. ..... 53/517; 53/435; 53/529; 53/530

(58) Field of Classification Search ..... 53/517, 53/529, 530, 435, 439
See application file for complete search history.

(56) References Cited

U.S. PATENT DOCUMENTS 2,015,089 A 9/1935 Rooney
3,700,386 A * 10/1972 Mencacci ..... 426/397
4,116,600 A 9/1978 Dutton
5,887,413 A 3/1999 Rowley et al.
6,622,458 B2 * 9/2003 Fischer et al. ..... 53/435
2002/0069622 A1 6/2002 Berciga et al.

FOREIGN PATENT DOCUMENTS

| | | |
|---|---|---|
| EP | 1448445 | 4/2006 |
| WO | 2004/103820 | 12/2004 |
| WO | 2008/109084 | 9/2008 |

OTHER PUBLICATIONS

EP Search Report for 08425826.8 filed on Dec. 31, 2008 in the name of John Bean Technology S.p.A.

* cited by examiner

*Primary Examiner* — Thanh Truong
(74) *Attorney, Agent, or Firm* — Steinfl & Bruno LLP

(57) ABSTRACT

A machine for canning tuna and similar food products comprises a conveyor belt feeder, a plurality of dosing chambers aligned with the feeder and formed in a rotor rotatable in a plane perpendicular to the feed direction, a mouth connecting the feeder to the dosing chambers, a blade to separate the product introduced in the dosing chambers from the bulk of fed product so as to obtain product cakes, shaping means suitable to shape the cakes into the desired shape and transferring means arranged at a second station reachable through a partial rotation of the rotor to transfer the shaped cakes into the cans carried by another rotor. The connecting mouth has a cross-section of substantially constant shape and the shaping is performed in the dosing chambers by shapers radially mobile along the arms of the rotor when the dosing chambers are still aligned with the feeder.

13 Claims, 9 Drawing Sheets

MACHINE AND METHOD FOR CANNING TUNA AND THE LIKE

CROSS REFERENCE TO RELATED APPLICATIONS

The present application claims priority to European patent application EP 08425826.8 filed on Dec. 31, 2008 and incorporated herein by reference in its entirety.

FIELD

The present disclosure relates to machines for canning tuna and the like, and in particular to a machine and method intended to minimize the damage to tuna during the canning process and to obtain cans of a substantially constant weight.

In the following, specific reference will be made to the canning of tuna yet it is clear that what is being said is also applicable to the canning of other food products having similar characteristics, such as other types of fish, meat, etc.

BACKGROUND

It is known that the main difficulties in canning tuna are obtaining cans of constant weight, so as to avoid production waste, and presenting the consumer with a good-looking product when the can is opened, since this determines the product value to a great extent. Such difficulties are not easy to overcome due to the intrinsic nature of tuna, which is a food product showing ample variations in compactness, density and shape from batch to batch where not even from loin to loin.

Moreover, the manufacturer tries to obtain the maximum quantity of finished product from the raw material, which should therefore be treated so as to avoid as much as possible crumbling and loss of liquids that lead to a decrease in weight of the raw material to be canned. Clearly, all of the above should be achieved through a machine that guarantees an adequate productivity, since machines and methods that are too slow result in excessive costs.

The main phases of the canning process are therefore the separation from the bulk of fed product of a tuna cake having a suitable weight, neither too low to risk obtaining an underweight can nor too high to reduce the yield of the raw material, and the shaping thereof into a shape suitable for the introduction into a can, typically a round cylindrical shape. In the following, specific reference will be made to the canning into conventional round cans, yet it is clear that what is being said is also applicable to the canning into cans having other shapes such as oval, rectangular with rounded corners and the like, as well as into jars or other containers.

Prior art machines and methods can be substantially divided in two categories depending on the sequence of the above-mentioned main phases, i.e. first dosing and then shaping or vice versa. In practice, in a first type of machine the product is shaped while being fed to the dosing chamber and the cake that is cut from the bulk of product already has a shape suitable for canning, whereas in a second type of machine a cake of suitable weight and generally quadrangular shape is cut from the bulk of product and subsequently shaped for the introduction into the can.

A recent example of a machine of the first type can be found in WO 2004/103820 that discloses a machine for obtaining simultaneously two conventional round cans, comprising a forming mouth, with a rectangular inlet and a binoculars-shaped outlet, which is crossed by a vertical knife that reciprocates perpendicularly to the feed direction to divide the tuna loin in two portions. Said mouth connects the conveyor belt tuna feeder to two dosing chambers formed in a rotor that rotates in a plane perpendicular to said feeder to take the two dosing chambers to a second station where the round cakes are transferred into the cans. This type of machine has several drawbacks resulting from the high push on the tuna required to go from the rectangular inlet portion of the mouth to the cornerless outlet portion.

A first drawback is the damage to the outer surface of the tuna that scrapes with high friction along the inner walls of the mouth to follow the great variation in shape of the cross-section; such a friction also causes a compression of the peripheral fibers of the tuna which therefore results having a non-uniform density when leaving the mouth. This compression also causes the further drawback of a "squeezing" of the tuna with loss of liquids and crumbles, which not only reduce the yield of the raw material but can also leak through the interstices of the machine causing the mechanisms to get soiled and clogged.

Still another drawback caused by such a friction is the fact that the central fibers of the tuna are more unimpeded in advancing with respect to the peripheral fibers whereby the cake that is obtained after the cut tends to be convex. This may cause problems in the steps following the canning since the central portion of the can, being higher, may get in contact with the can lid and therefore burn during the sterilization process or it may not be sufficiently covered by the control liquid (oil or other).

Finally, it should be noted that this canning method is even more sensible to the already high intrinsic variability of tuna, since the push of the conveyor belts on the tuna must be continuously adjusted and is affected by the flow of the bulk of fed product and by possible irregularities or pauses in the infeed. This also affects the precision in determining the cake weight, despite the presence of load cells that control the operation of the conveyor belts depending on the push exerted by the tuna on bottom plugs that close the dosing chambers.

The most common example of the second type of machine has remained practically unchanged in the last three decades and is described in U.S. Pat. No. 4,116,600: the tuna is cut in an approximate amount by a knife located at the end of the conveyor belt feeder, then pushed perpendicularly by a ram into a metering pocket with a semicircular concave bottom where a second knife closes the pocket and defines the exact amount. This metering pocket consists of two adjacent peripheral pockets formed in two rotating turrets between which there is arranged a third knife that divides the thus formed tuna cake in two cakes, and each turret then rotates independently towards a second station where the shaping is completed by a relevant radial plunger shaped with a concave semicircular contact surface prior to moving the cake to a third station where the transfer into the can takes place.

Although this type of machine does not subject the tuna to the high friction of a forming mouth as in the first type of machine, nonetheless it also has various drawbacks of a different kind.

In the first place, the product dosing is achieved by filling the metering pocket by means of the perpendicular ram that must compress the tuna with a pressure as uniform as possible in order to obtain a density and therefore a cake weight which is constant. However, as discussed above, the intrinsic nature of tuna and the irregularities in shape, infeed and flow make it difficult to achieve a constant weight, in particular since there are no load cells or other systems that provide a feedback to the feeder. On the other hand, increasing the ram force in order to reduce the effect of such irregularities leads to the "squeezing" of the tuna with increased damage to the product and a lower yield.

Secondarily, although the tuna is not forced through a forming mouth yet it undergoes three cuts along different surfaces and two displacements before obtaining the final shape: a first displacement by the ram scraping perpendicularly to the conveyor belt to enter the metering pocket, and a second displacement in the turret scraping against the inner surface of the machine casing between the first and second station. This still implies various frictions with subsequent losses of liquid and risks of crumbling, in addition to a certain degree of complexity of the machine that also has a low productivity exactly due to the several movements required to perform this canning method. Moreover, the rotating speed of the turrets can not be too high in order to prevent the centrifugal force from increasing the friction of the tuna against the casing during the rotation.

The subsequent improvements to this machine disclosed in the patent publications U.S. Pat. No. 5,887,413 and WO 2008/109084 respectively relate to the possibility of changing the cake thickness by means of adjustable end plates and the possibility of always having the surface of the last cut facing the can lid thanks to opposite knock-out plungers, yet they do not overcome any of the above-mentioned drawbacks.

The same drawbacks, even to a higher degree, are present in the machine disclosed in EP 1448445 that performs a similar canning method but it provides the division of the cake in the metering pocket by pushing the tuna against a fixed blade and a subsequent sub-division in a second chamber by pushing it against a second fixed blade prior to shaping. It is obvious that the higher number of displacements and the use of fixed blades increase the friction, the losses and the damage to the product.

SUMMARY

According to a first aspect, a machine for canning tuna and similar food products is provided, comprising a conveyor belt feeder; at least one dosing chamber aligned with said conveyor belt feeder and formed in a first rotor rotatable in a plane perpendicular to a feed direction; a mouth connecting the conveyor belt feeder to said at least one dosing chamber; cutting means suitable to separate a product introduced in the at least one dosing chamber from the bulk of fed product to obtain a product cake; shaping means suitable to shape said product cake into a shaped cake having a desired shape; and transferring means arranged at a station reachable through a partial rotation of said first rotor and suitable to transfer the shaped cake from the at least one dosing chamber into a can carried by a can feeder, wherein said mouth has a cross section of substantially constant shape, the at least one dosing chamber is defined within a corresponding at least one shaping chamber by way of mobile shutters adapted to bound, with flat surfaces, radial ends of said at least one shaping chamber, said shaping means comprise i) a shaped radial terminal of the at least one shaping chamber and ii) at least one opposite shaped member radially mobile between a rest position and a work position in which the product is pushed against said shaped radial terminal, said mobile shutters are mobile between a rest position and a work position in which said mobile shutters occupy the radial ends of the at least one shaping chamber, and driving means for said mobile shutters and said at least one shaped member are adapted to i) remove the mobile shutters from the at least one shaping chamber and ii) subsequently perform radial movement of the at least one shaped member when the at least one shaping chamber is still aligned with the conveyor belt feeder.

According to a further aspect, a method for canning tuna and similar food products is provided, comprising the steps of: a) feeding a product to one or more dosing chambers at a first station by way of a feeder and a connecting mouth unsuitable to perform any significant shaping of the bulk of fed product passing therethrough; b) separating the product introduced in the one or more dosing chambers from the bulk of fed product to obtain a product cake; c) shaping said product cake into a desired shape thus forming a shaped cake; d) moving the shaped cake to a second station; and e) transferring the shaped cake into a can.

In accordance with embodiments of the present disclosure, a method that provides first the dosing and then the shaping of the cake in a same first station without intermediate displacements is described, together with machine that performs said method with a structure that is generally similar to that disclosed in WO 2004/103820 (incorporated herein by reference in its entirety) yet without the forming mouth but with radial shaping members that act at the first station.

In accordance with embodiments of the present disclosure, frictions and displacements are minimized and weight control is achieved through feedback of pressure sensors (load cells or the like).

The teachings of the present disclosure can be applied to machines with different productivity levels depending on the needs, still maintaning a substantial structural simplicity.

BRIEF DESCRIPTION OF THE DRAWINGS

The teaching of the present disclosure will be clear to those skilled in the art from the following detailed description of an embodiment thereof, with reference to the annexed drawings wherein.

DESCRIPTION OF EXAMPLE EMBODIMENTS

Figure 1:
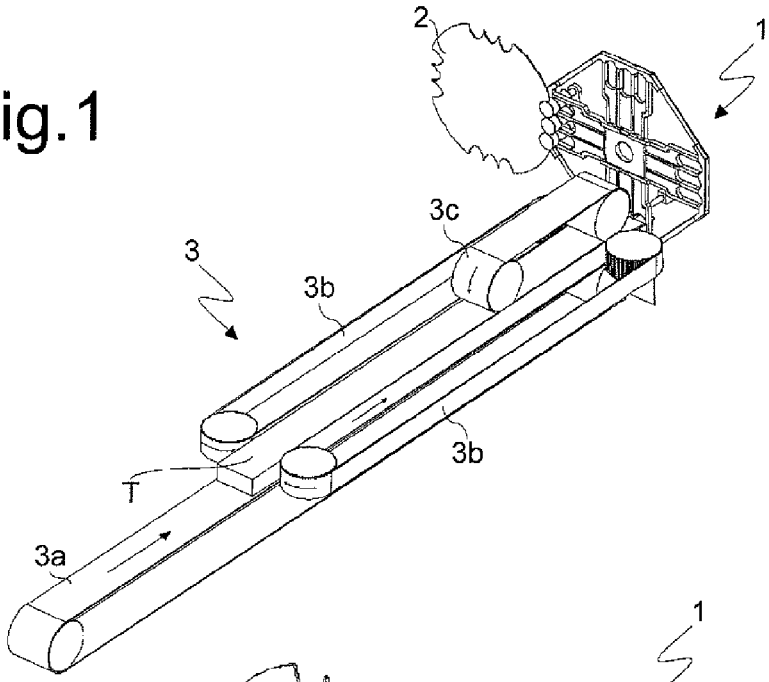
FIG. 1 is front perspective view diagrammatically showing the basic elements of the machine according to the present disclosure.
Figure 2:
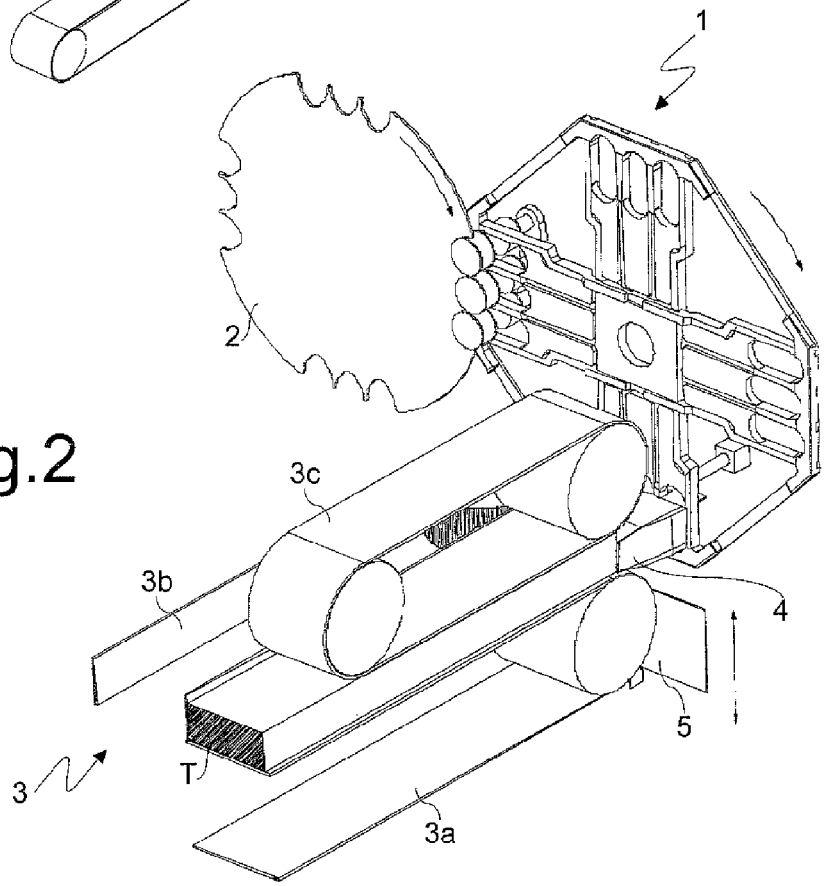
FIG. 2 is a partial enlarged view similar to the preceding one where some details of said machine are shown.

With reference to FIGS. 1 and 2, a machine according to the present disclosure has a general structure similar to the machine described in WO 2004/103820, since it includes a main rotor 1 and secondary rotor 2 partially overlapping and rotating in planes perpendicular to a conveyor belt feeder 3 that feeds the bulk of tuna T. Said feeder 3 conventionally includes a bottom belt 3*a*, two shorter side belts 3*b* and an even shorter top belt 3*c* that cooperate in conveying the bulk of tuna T to a mouth 4, more visible in FIG. 2 where the right side belt 3*b* has been removed for the sake of clarity.

This mouth 4 connects the outlet of feeder 3 to three dosing chambers formed in the main rotor 1 and aligned with said outlet. A bottom blade 5 reciprocates vertically between the outlet of mouth 4 and rotor 1 to form in the three dosing chambers three tuna cakes separate from the bulk of tuna T, as it will be better illustrated further on.

Although the figures show an exemplary embodiment suitable for the simultaneous canning of three tuna cakes, the machine and method according to the present disclosure can be applied to the production of a different number of cans at each cycle (one, two, four or more), three being considered the optimal compromise between the complexity and productivity of the machine. In fact, it is clear for a person skilled in the art that the size of the above-illustrated members, namely rotors 1 and 2, feeder 3, mouth 4 and blade 5 can be easily adapted to a different number of cans to be produced at each machine cycle as well as to cans of different shapes.

Figure 3:
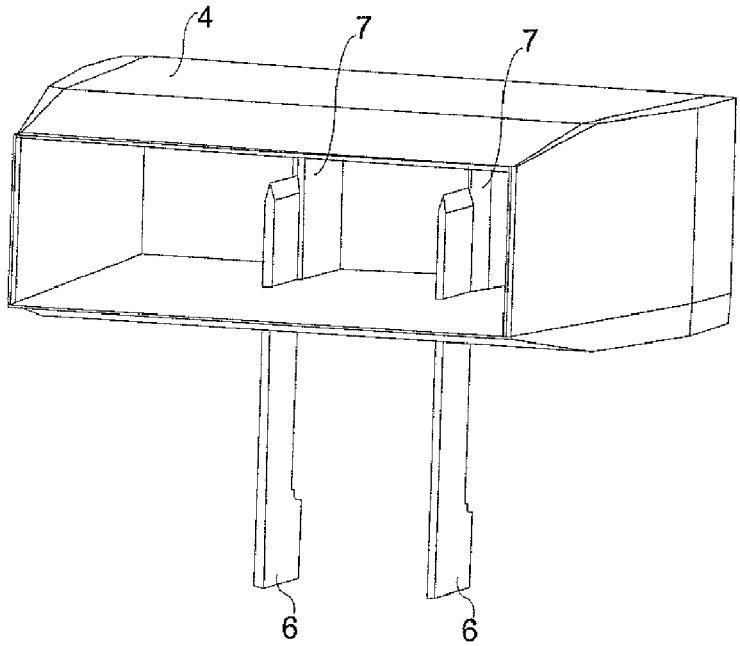
FIG. 3 is a front perspective view of the mouth connecting the feeder to the dosing chambers, with the cutting means for dividing longitudinally the bulk of tuna being fed.
Figure 4:
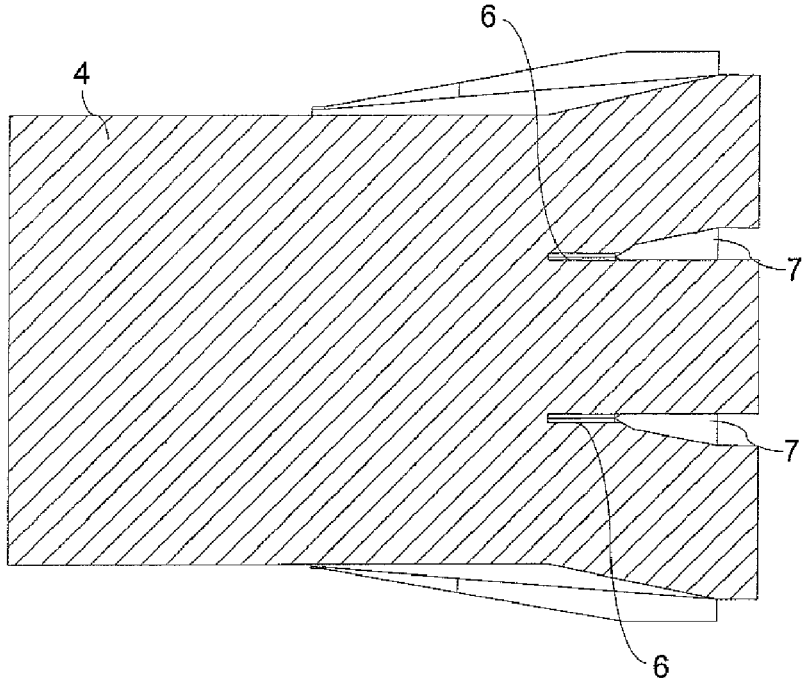
FIG. 4 is a top plan view of the mouth of FIG. 3 without the top wall.

As previously mentioned, a first novel feature of the present machine is given by the connecting mouth 4 that is illustrated in detail in FIGS. 3 and 4. This mouth 4 has a cross-section of substantially constant shape so as not to perform any significant shaping of the bulk of tuna passing therethrough in order to prevent the problems mentioned in the introductory portion of the present specification, such as the friction along the perimeter, for example a rectangular shape that divides into three separate square sections of substantially equal area.

This is particularly clear from the top plan view of FIG. 4 showing how the hatched area, corresponding to the tuna passage cross-section, remains unchanged for most of the length of mouth 4 up to in proximity to the outlet where a pair of chisel knives 6, provided with a vertical reciprocating motion synchronized with the movement of feeder 3, are arranged before a pair of wedge diverters 7 to divide longitudinally the bulk of tuna in three portions and to direct the two external portions to the two outer dosing chambers.

However, the cross-sectional area of mouth 4 may have a slight decrease between the inlet cross-section and the outlet cross-section, said decrease being suitable to achieve a slight pre-compression of the product useful to make up for possible irregularities in infeed by feeder 3. For example, the cross-section of mouth 4 may have a rectangular shape, or more generally a quadrangular shape, at the inlet cross-section and a rectangular shape with bevelled corners at the outlet cross-section, which also favours the introduction of the tuna into the dosing chambers.

Figure 5:
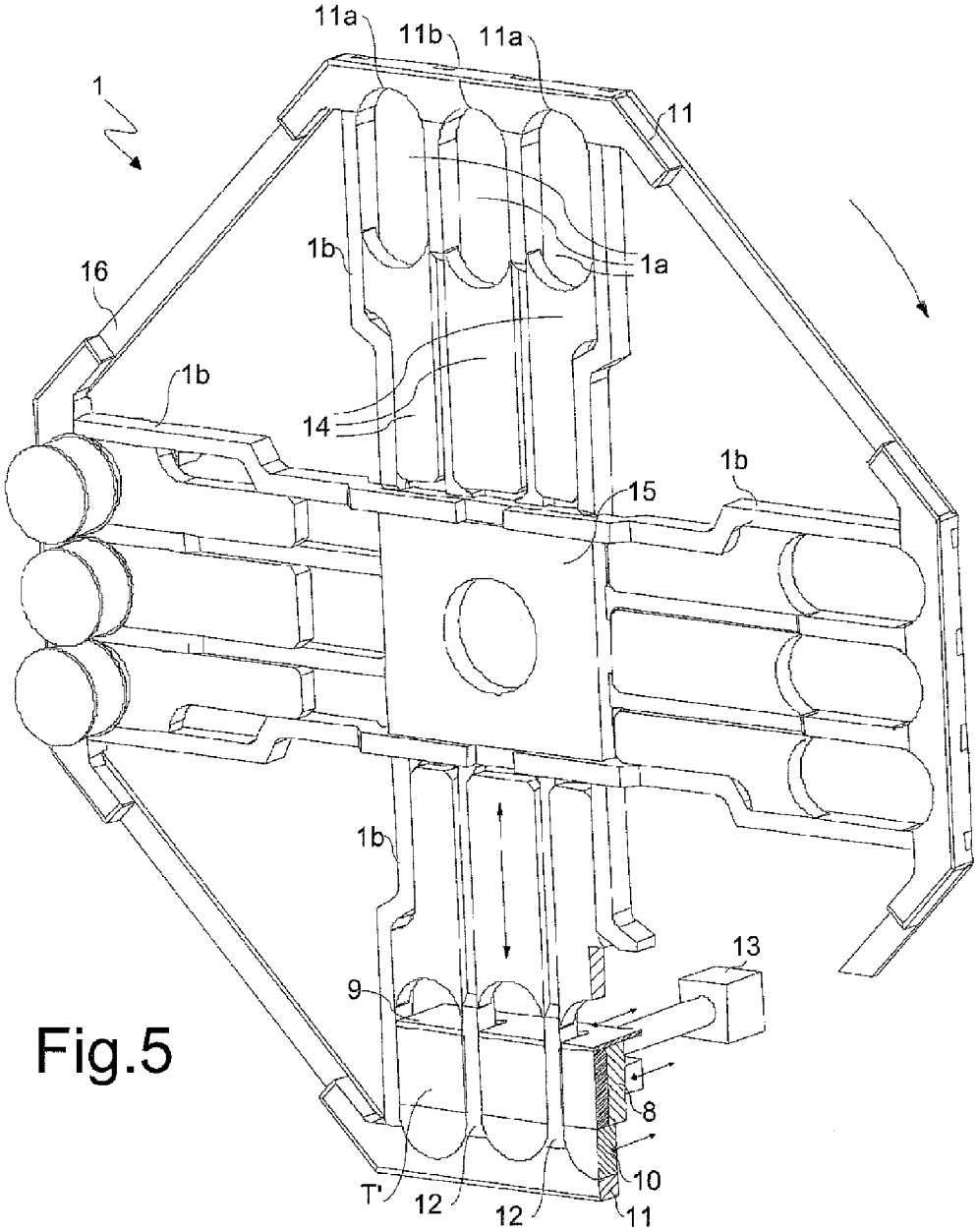
FIG. 5 is a front perspective view of the main rotor, with a portion removed for the sake of clarity, in a position between the dosing phase and the shaping phase.

FIG. 5 illustrates in grater detail the structure of the main rotor 1 that sequentially achieves the dosing and shaping of the tuna cakes at a same station, prior to moving them to a subsequent station where they are transferred into the cans.

Rotor 1 is substantially cross-shaped with a group of three shaping chambers 1*a* formed side by side in each one of the four identical arms 1*b* of the cross, that rotates clockwise as indicated by the arrow. The structure and operation of the machine will be described in the following with specific reference to the placement of the first dosing and shaping station in the bottom position of rotor 1, i.e. the "6 o'clock" position, and of the second cake transferring station in the following left position, i.e. the "9 o'clock" position, but this is just one of the several possible placements of the two stations.

What is being said is also applicable with the two stations located in other positions, even not consecutive, where the first station should precede the second station in the direction of rotation of rotor 1. Therefore, in the following, reference will be made in general to the internal/external or proximal/distal position of the members, meant with respect to the radial direction, since the above-mentioned two stations can be located at any of the positions of rotor 1.

At the first station, the three dosing chambers are defined at the distal ends of the three shaping chambers 1*a* by a front plug 8, that acts as back of the chambers and stops the advancing of the bulk of tuna T, by a flat internal shutter 9 and by an external shutter 10 that has an internal flat surface, in contact with the tuna, and an external surface shaped to mate with the internal shaped surface of terminal 11 of arm 1*b*, that acts as distal end of the shaping chambers 1*a*.

More specifically, said internal surface of terminal 11 can have two substantially semi-circular lateral profiles 11*a* and a central profile 11*b* slightly offset inwards and therefore extending along an arc of circle shorter than a half-circle, the remaining portion of the half-circle being formed in the radial baffles 12 that divide the three shaping chambers 1*a*. This position offset in the radial direction allows to decrease the distance in the circumferential direction between the dosing chambers, consequently reducing the transverse displacement required to the lateral portions of tuna cut by knives 6 and guided by diverters 7 towards the lateral dosing chambers, thus resulting in a minimized damage to the product.

The front plug 8 is connected to a cake dosing control system 13 comprising a pressure sensor, e.g. a load cell, whose output signal is used for the feedback control of feeder 3, as already known from WO 2004/103820 yet without the problems caused by feeding the tuna through a forming mouth. The control system 13 may also include a dynamic scale (not shown) or other control system suitable to detect the weight of the cans leaving the machine and to compare it with the values detected by the pressure sensor so as to perform a dynamic feedback adjustment of said sensor.

Plug 8 and shutters 9, 10 are longitudinally mobile, by means of respective actuators not shown, between a rest position and a work position in which they define the sides of the dosing chambers, as indicated by the respective arrows in FIG. 5. For structural simplicity plug 8, and shutters 9, 10 can be formed as single bodies shaped to enter the shaping chambers 1*a* astride the radial baffles 12. However, it would also be possible to provide separate bodies for each shaping chamber which however would require multiple actuators. In any case, for an effective operation of the control system 13 as mentioned above, usually a single plug 8 connected to the pressure sensor is provided. Furthermore, the work position of said plug 8 can be adjustable by the control system 13 within a 2-3 mm range, in order to achieve a further possibility of adjustment of the cake weight.

Figure 7:
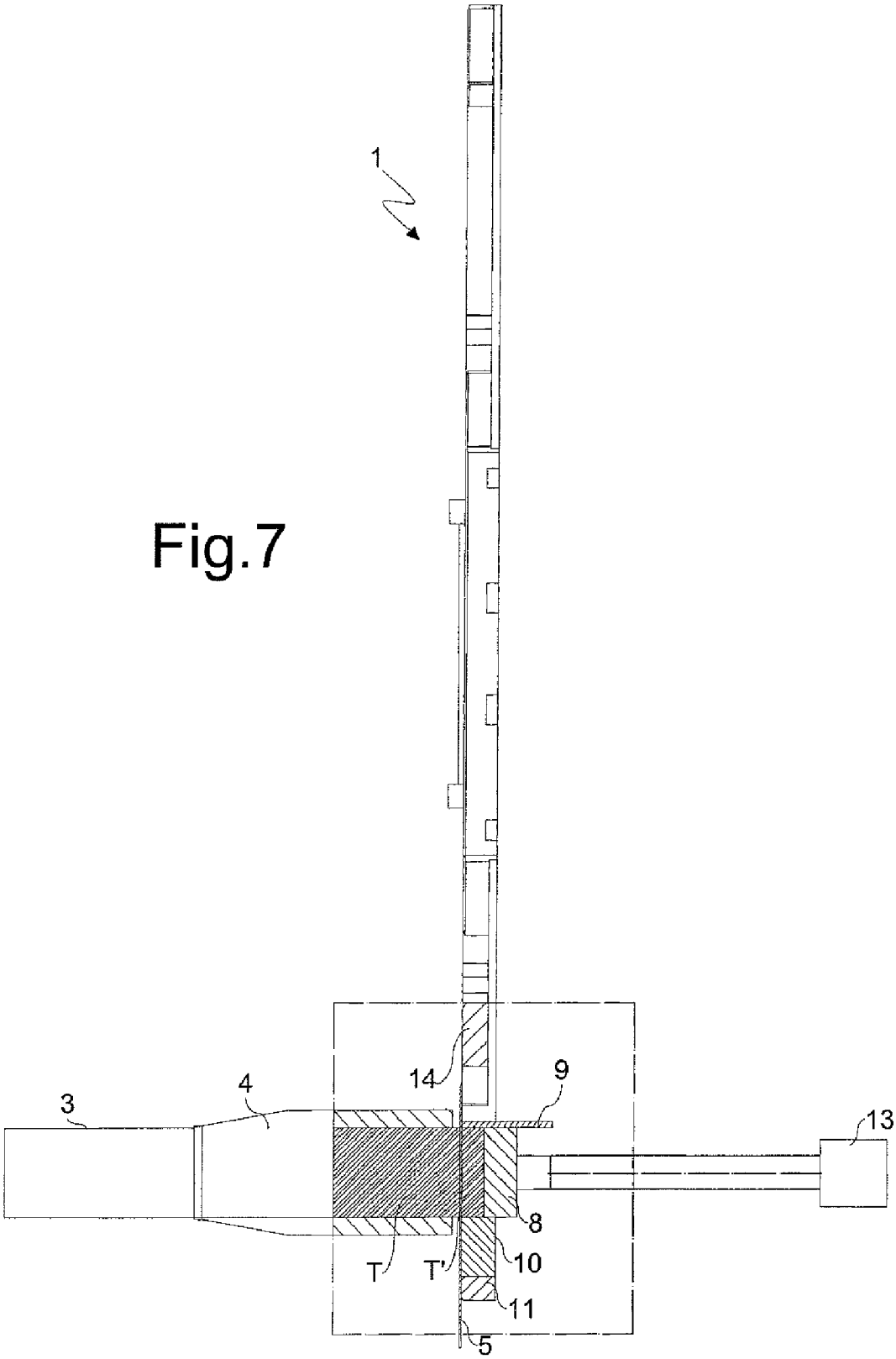
FIG. 7 is a view similar to FIG. 6 showing the step of separating the tuna cakes.

To carry out the cylindrical round shaping of the tuna cakes T' having a substantially parallelepipedal shape that are obtained from the cut performed by blade 5, as shown in FIG. 7, a mobile member 14 having the external surface with a semi-circular shape, called "shaper", is arranged in a radially slidable way in each shaping chamber 1*a* to the inside of the dosing chamber.

To take into account the adjustment range of the position of plug 8, the longitudinal thickness of shapers 14 should correspond to the maximum possible depth of the dosing chambers. Therefore there is generally interference between the radial movement of shapers 14 and the work position of plug 8. Moreover, to take into account the offset position of the central profile 11*b*, the radial length of the central shaper 14 should be correspondingly reduced (or vice versa increased if the central profile 11*b* were offset outwards).

The radial reciprocating motion of shapers 14, indicated in FIG. 5 by the respective arrow, is performed by means of actuators generally arranged at hub 15 of rotor 1, where also the rotary motion for the whole rotor 1 is received. These actuators are not illustrated since they can be made according to different modes, well known to a person skilled in the art. Finally, in order to provide greater structural rigidity to rotor 1, arms 1*b* can be mutually connected through connecting rods 16 joining terminals 11.

The simple and effective operation of the canning machine according to the present disclosure and the relevant canning method are readily understood from the following description given with reference to FIGS. 6 to 10, in which the region within the dotted frame is depicted in vertical cross-section for the sake of clarity.

Figure 6:
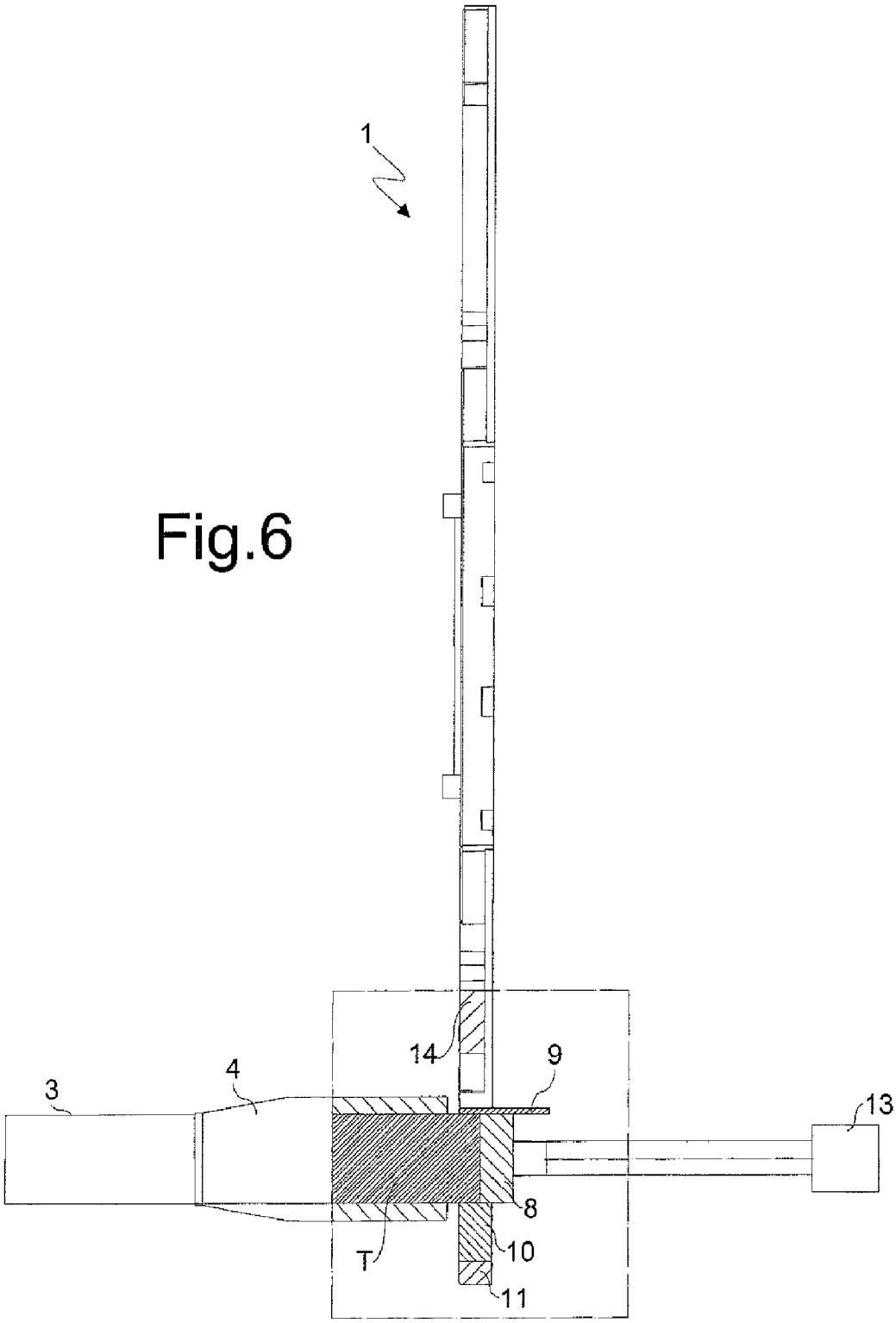
FIG. 6 is a lateral partially sectional view of the machine of FIG. 1, in the initial step of feeding tuna to the dosing chambers.

In the initial position of FIG. 6, the bulk of tuna T advanced through the connecting mouth 4 until it stopped against plug 8, which together with shutters 9 and 10 defines the dosing chambers, and the pressure of tuna on plug 8 detected by the control system 13 through the pressure sensor caused feeder 3 to stop.

Figure 8:
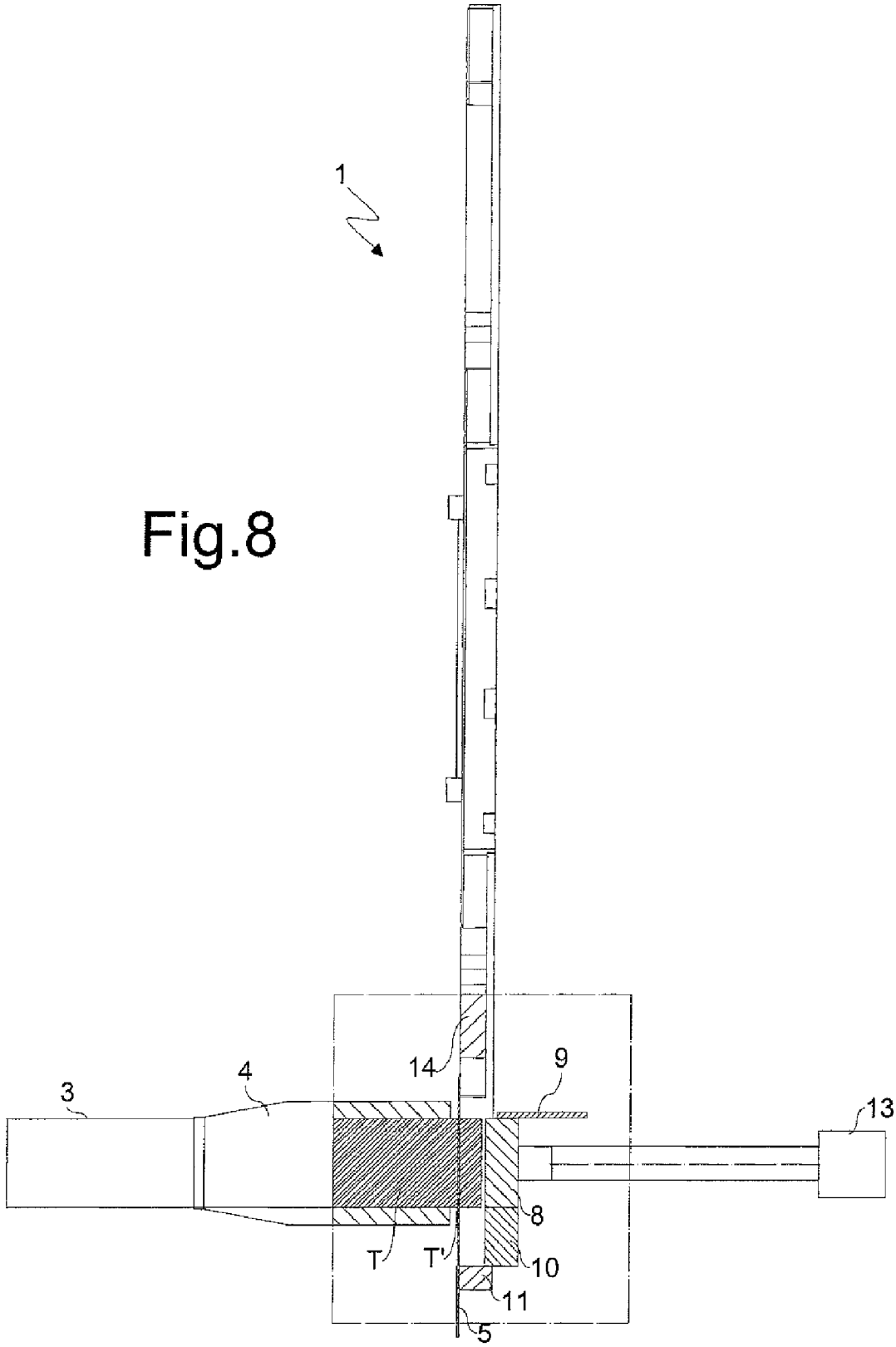
FIG. 8 is a view similar to FIG. 6 showing the step of preparing for the shaping of the tuna cakes.

In the following step of separation of the tuna cakes, as shown in FIG. 7, blade 5 rises to cut the bulk of tuna T and closes the front of the dosing chambers in which cakes T' of parallelepipedal shape remain. After that, as shown in FIG. 8, plug 8 and the external shutter 10 move back to avoid interference with the radial movement of shapers 14, lining up so as to form the back of the shaping chambers, whereas the internal shutter 9 moves back farther stopping outside rotor 1.

Figure 9:
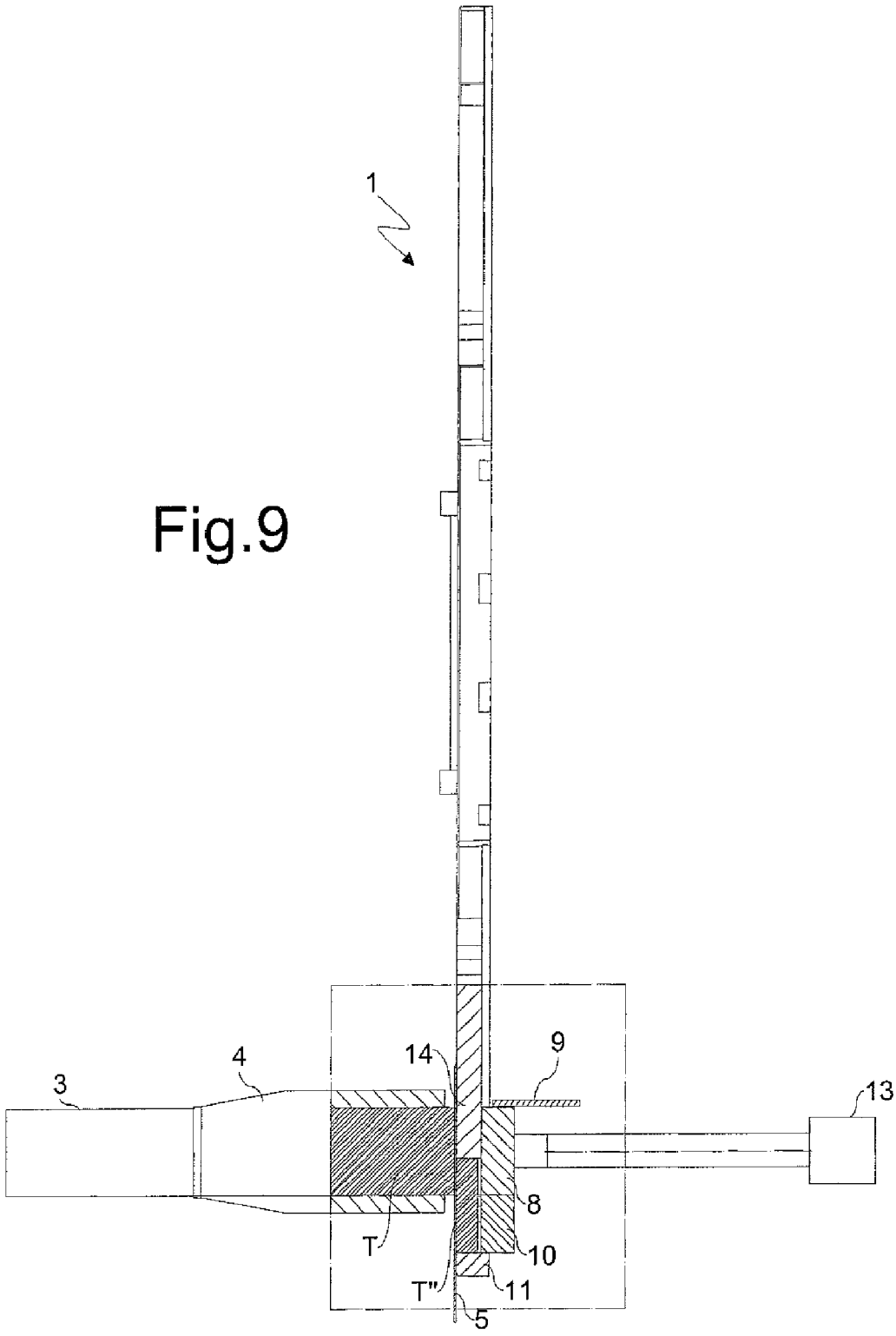
FIG. 9 is a view similar to FIG. 6 showing the step of shaping the tuna cakes.
Figure 10:
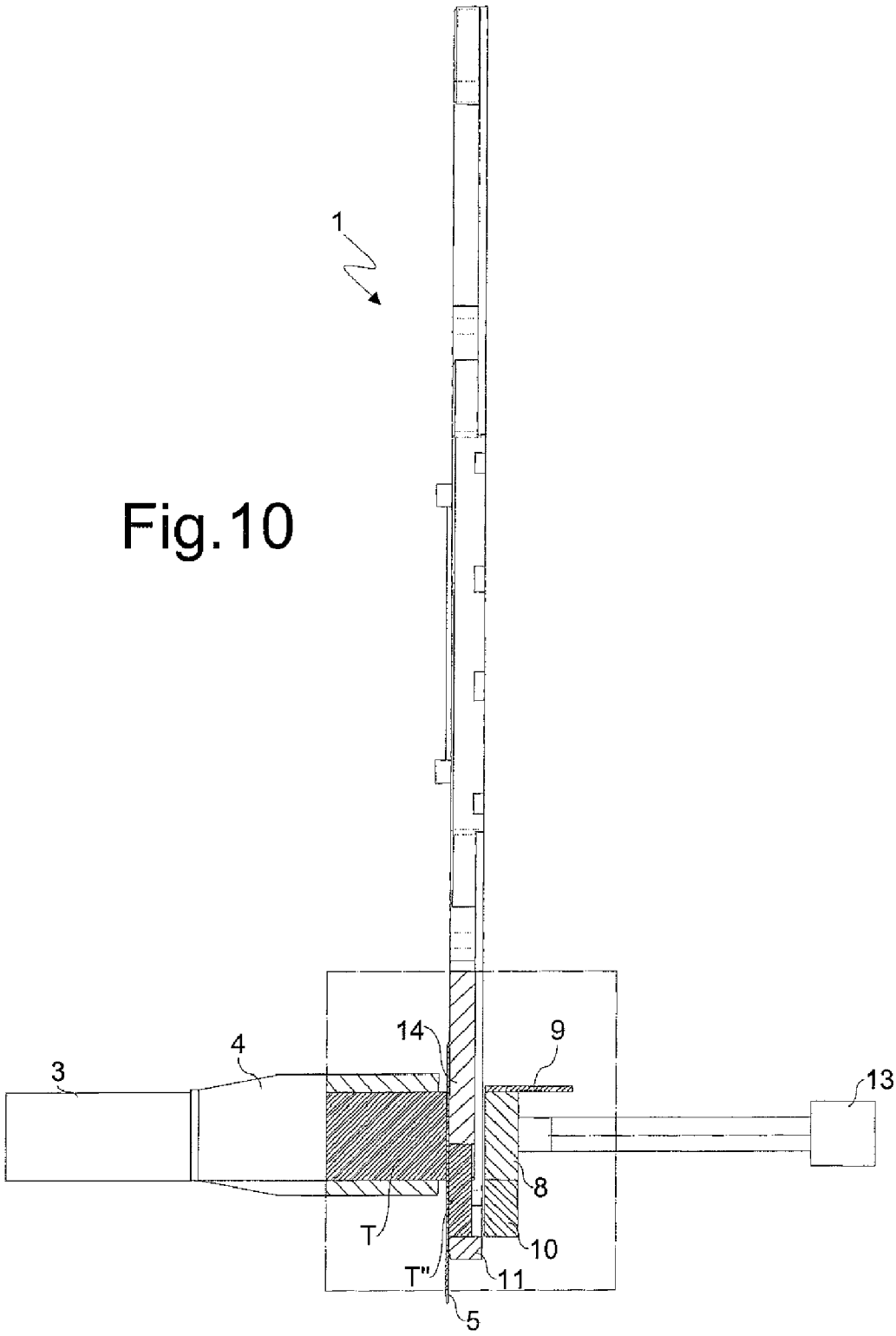
FIG. 10 is a view similar to FIG. 6 showing the step of preparing for the displacement of the shaped cakes towards the station of transfer into the cans.

In this position it is possible to perform the shaping phase of the tuna cakes T', as shown in FIG. 9, in which the cakes are pushed by the radial movement of shapers 14 against the shaped internal surface of terminal 11, that shapes the outer half thereof, while the external surface of shapers 14 shapes the internal half thereof. At this moment the tuna cakes T" have taken a cylindrical round shape and are firmly retained by shapers 14 against terminal 11, while plug 8 and the external shutter 10 move back further to line up with the internal shutter 9 outside rotor 1, as shown in FIG. 10.

Figure 11:
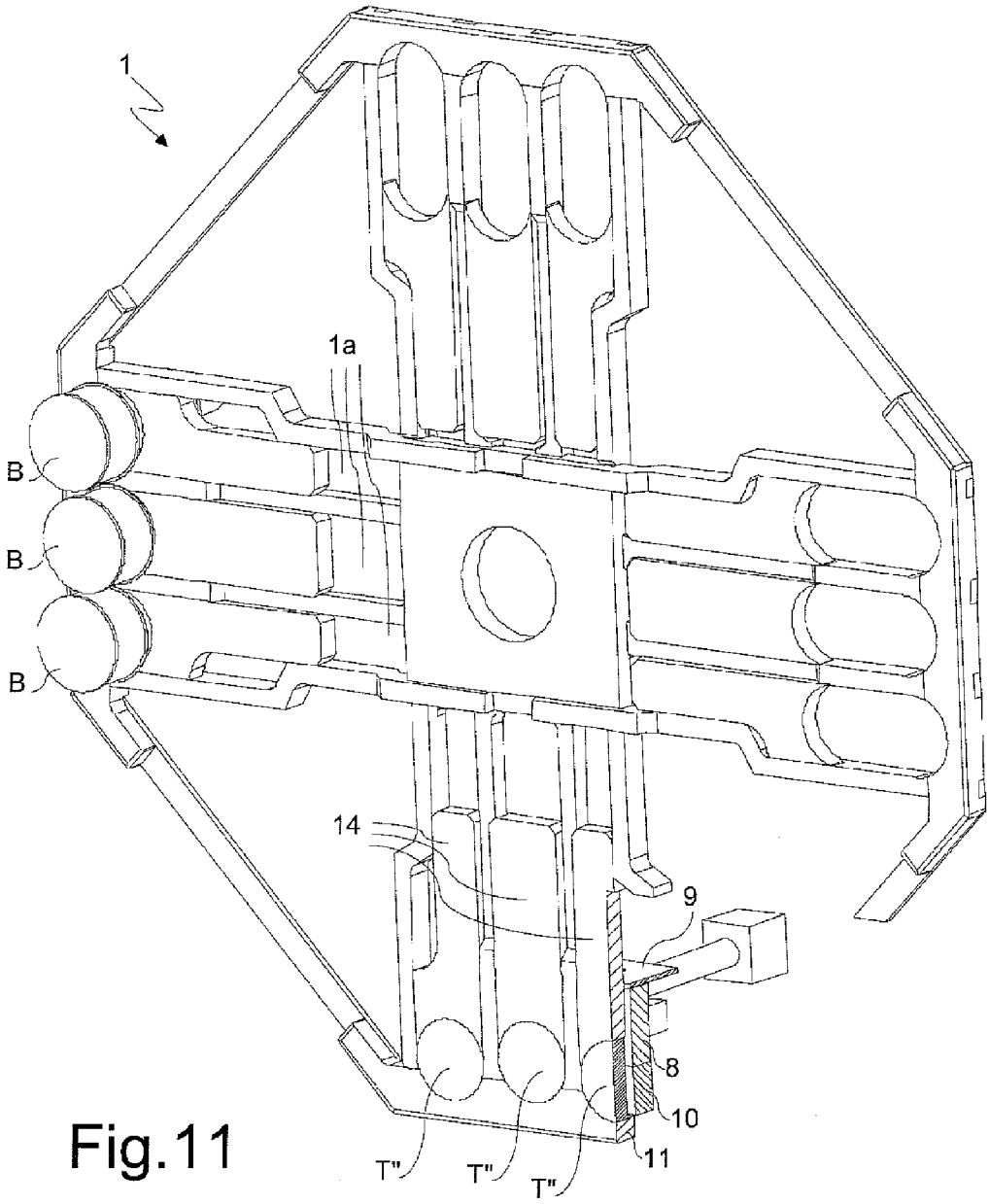
FIG. 11 is a front perspective view of the main rotor, with a portion removed for the sake of clarity, in the step corresponding to FIG. 10.

This is also the position illustrated in the perspective view of FIG. 11, from which it is clear how the three round cakes T" can be taken through a clockwise 90° rotation to the second station where they will be transferred by known means not shown, typically plungers, into three cans B carried by the secondary rotor 2 (not shown). Since the displacement from the first station to the second station occurs with cakes T" already shaped and held by shapers 14 it is clear that it may be performed quickly and without damage to the product.

Finally, after transferring the cakes into the cans, shapers 14 return to the rest position at the proximal end of the shaping chambers 1*a* for the passage through the other two "12 o'clock" and "3 o'clock" positions that are mere transit stations. Obviously, since all four arms 1*b* are identical, each complete rotation of rotor 1 corresponds to four canning cycles and therefore to the production of 12 cans, proof of the high productivity of the present machine.

It is clear that the above-described and illustrated embodiment of the machine and method according to the disclosure is just an example susceptible of various modifications. In particular, in addition to the various possible changes already mentioned above, the separation of the tuna cakes T' from the bulk of tuna T and the division of the latter into a plurality of portions can be achieved by cutting means respectively different from blade 5 and knives 6 although technically equivalent (e.g. rotating blades).

Similarly, the feeder of cans B to the second station could be made different from the secondary rotor 2 (e.g. rail guides) and could take cans B to the opposite side of rotor 1 with respect to what is illustrated in FIGS. 1, 2 and 11. In this way, the smoothest side of cakes T" which was in contact with blade 5 would be on the top side of cans B upon transfer.

Finally, rotor 1 can have a different number of arms 1*b* as long as they are equally spaced along the periphery thereof.

The invention claimed is:

1. A machine for canning tuna and similar food products, comprising a conveyor belt feeder;

at least one dosing chamber aligned with said conveyor belt feeder and formed in a first rotor rotatable in a plane perpendicular to a feed direction;

a mouth connecting the conveyor belt feeder to said at least one dosing chamber;

cutting means suitable to separate a product introduced in the at least one dosing chamber from the bulk of fed product to obtain a product cake;

shaping means suitable to shape said product cake into a shaped cake having a desired shape; and transferring means arranged at a station reachable through a partial rotation of said first rotor and suitable to transfer the shaped cake from the at least one dosing chamber into a can carried by a can feeder, wherein said mouth has a cross section of substantially constant shape, the at least one dosing chamber is defined within a corresponding at least one shaping chamber by way of mobile shutters adapted to bound, with flat surfaces, radial ends of said at least one shaping chamber, said shaping means comprise i) a shaped radial terminal of the at least one shaping chamber and ii) at least one opposite shaped member radially mobile between a rest position and a work position in which the product is pushed against said shaped radial terminal, said mobile shutters are mobile between a rest position and a work position in which said mobile shutters occupy the radial ends of the at least one shaping chamber, and driving means for said mobile shutters and said at least one shaped member are adapted to i) remove the mobile shutters from the at least one shaping chamber and ii) subsequently perform radial movement of the at least one shaped member when the at least one shaping chamber is still aligned with the conveyor belt feeder.

2. The machine according to claim 1, further comprising a mobile plug longitudinally mobile between a rest position and a work position in which the mobile plug acts as back of the at least one dosing chamber, said mobile plug being connected to a control system comprising a pressure sensor whose output signal is used for feedback control of the conveyor belt feeder.

3. The machine according to claim 2, wherein the pressure sensor is a load cell.

4. The machine according to claim 2 or 3, further comprising a scale arranged downstream of the station to detect weight of the cans leaving the machine and whose output signal is used for feedback control of the adjustment of the pressure sensor.

5. The machine according to claim 2 or 3, further comprising a device for adjusting the work position of the mobile plug.

6. The machine according to any one of claims 1 to 3, wherein the area of the cross section of the mouth decreases between an inlet cross section of the mouth and an outlet cross section of the mouth to an extent suitable to achieve a slight pre-compression of the product.

7. The machine according to any one of claims 1 to 3, wherein the cross section of the mouth has a quadrangular shape at an inlet cross section of the mouth and a quadrangular shape with bevelled corners at an outlet cross section of the mouth.

8. The machine according to any one of claims 1 to 3, wherein the at least one dosing chamber is a plurality of dosing chambers formed side by side in the rotor, the machine further comprising one or more vertical cutting means passing through the mouth so as to divide longitudinally the bulk of fed product in as many parts as the dosing chambers; and a wedge diverter arranged downstream of each cutting means, adapted to direct a portion of the product towards a respective dosing chamber.

9. The machine according to claim 8, wherein all the mobile plugs are joined to form a single plug and connected to a single pressure sensor.

10. The machine according to claim 8, wherein the at least one dosing chamber is at least three dosing chambers, each chamber being slightly offset in a radial direction with respect to adjacent chambers.

11. The machine according to any one of claims 1 to 3, wherein the can feeder is a second rotor rotatable in a plane parallel to a plane of rotation of the first rotor and partially overlapping the first rotor.

12. The machine according to claim 1, wherein the feed direction of the bulk of fed product on the conveyor belt feeder is perpendicular to the plane of rotation of the first rotor.

13. The machine according to claim 1, wherein the at least one dosing chamber is aligned with the conveyor belt feeder such that the bulk of fed product enters the at least one dosing chamber from the conveyor belt through the mouth in a direction parallel to the feed direction.

* * * * *